US007302071B2

(12) United States Patent
Schumaier

(10) Patent No.: US 7,302,071 B2
(45) Date of Patent: Nov. 27, 2007

(54) BONE CONDUCTION HEARING ASSISTANCE DEVICE

(76) Inventor: Daniel R. Schumaier, 1548 Blue Springs Rd., Elizabethton, TN (US) 37643

( * ) Notice: Subject to any disclaimer, the term of this patent is extended or adjusted under 35 U.S.C. 154(b) by 615 days.

(21) Appl. No.: 10/941,342

(22) Filed: Sep. 15, 2004

(65) Prior Publication Data

US 2006/0056649 A1 Mar. 16, 2006

(51) Int. Cl.
*H04R 25/00* (2006.01)

(52) U.S. Cl. ..... 381/326; 381/151; 381/328; 381/330

(58) Field of Classification Search ..... 381/322, 381/324, 326–328, 330, 151, 380–381; 181/129–131
See application file for complete search history.

(56) References Cited

U.S. PATENT DOCUMENTS

| | | | |
|---|---|---|---|
| 2,203,379 | A | 6/1940 | Bush |
| 2,938,083 | A | 5/1960 | Herrmann |
| 3,594,514 | A | 7/1971 | Wingrove |
| 3,688,863 | A | 9/1972 | Johnson |
| 3,764,748 | A | 10/1973 | Branch et al. |
| 4,150,262 | A | 4/1979 | Ono |
| 4,588,867 | A | 5/1986 | Konomi |
| 4,612,915 | A | 9/1986 | Hough et al. |
| 4,937,876 | A | 6/1990 | Biermans |
| 5,015,225 | A | 5/1991 | Hough et al. |
| 5,047,994 | A | 9/1991 | Lenhardt et al. |
| 5,091,952 | A | 2/1992 | Williamson et al. |
| 5,185,802 | A | 2/1993 | Stanton |
| 5,201,007 | A | 4/1993 | Ward et al. |
| 5,447,489 | A | 9/1995 | Issalene et al. |
| 5,606,621 | A | 2/1997 | Shennib et al. |
| 5,701,348 | A | 12/1997 | Shennib et al. |
| 5,857,958 | A | 1/1999 | Ball et al. |
| 5,935,166 | A | 8/1999 | Kennedy |
| 6,010,532 | A | 1/2000 | Kroll et al. |
| 6,041,129 | A | 3/2000 | Adelamn |
| 6,137,889 | A | 10/2000 | Shennib et al. |
| 6,643,378 | B2 | 11/2003 | Schumaier |
| 6,751,334 | B2 | 6/2004 | Hakansson |
| 2002/0118852 | A1 | 8/2002 | Boesen |

FOREIGN PATENT DOCUMENTS

| | | |
|---|---|---|
| JP | 52120841 | 10/1977 |

(Continued)

OTHER PUBLICATIONS

Affidavit of Larry Hatfield (Including Photos), Apr. 11, 2001.

*Primary Examiner*—Suhan Ni
(74) *Attorney, Agent, or Firm*—Luedeka, Neely & Graham, P.C.

(57) ABSTRACT

A bone conduction hearing aid includes an in-the-ear (ITE) component and a behind-the-ear (BTE) component. A bone vibrator is carried by the ITE component and positioned in the concha of the ear when in use. A vibrationally conductive structural member of the ITE component conducts vibration produced by the vibrator into the ear canal. From there, the vibration is transferred to a cochlea of the user by way of the mastoid bone, enabling enhanced hearing perception in patients with hearing loss.

18 Claims, 3 Drawing Sheets

FOREIGN PATENT DOCUMENTS

| | | |
|---|---|---|
| JP | 5561197 | 5/1980 |
| JP | 58188996 | 11/1983 |
| JP | 59-191996 | 10/1984 |
| JP | 59191996 | 10/1984 |
| JP | 362151100 | 7/1987 |
| JP | 06189397 | 7/1994 |
| JP | 06217399 | 8/1994 |
| JP | 10145896 | 5/1998 |
| WO | 9621334 | 7/1996 |

BONE CONDUCTION HEARING ASSISTANCE DEVICE

FIELD OF THE INVENTION

The present invention relates generally to hearing aids. More particularly, the present invention relates to a bone conduction hearing assistance device having a vibrator which is placed in the concha of the ear.

BACKGROUND OF THE INVENTION

For many hearing loss patients, bone conduction hearing aids offer a better solution than more conventional acoustic/air transmitting hearing aids. Indeed, for some patients bone conduction hearing aids offer the only solution. Bone conduction hearing assistance generally involves vibration of the patient's mastoid bone to improve hearing perception. In a typical bone conduction hearing aid, sound sensed by a microphone is converted to an electrical signal and amplified. The amplified signal is then received by a small vibrator which vibrates the mastoid bone. Strategic placement of the vibrator on the user is essential in order to achieve optimal results. For example, some bone conduction hearing aids teach that the vibrator should be placed against the skin behind the ear, while others teach placing the vibrator on the forehead. Still others teach surgical implantation of the vibrator directly into the mastoid bone for better transmission of vibration. However, all of these approaches have significant disadvantages.

One particularly effective approach has been to mount the vibrator on an in-the-ear structural member. The structural member is inserted in the patient's ear canal so that the vibrator is positioned adjacent the mastoid bone. While this approach has been shown to provide excellent vibration transfer characteristics, it is unavailable for patients with ear canals too small to receive the vibrator, such as patients who suffer from congenital atresia—a condition where the ear canal is narrowed or, in some cases, entirely closed off from the ear drum.

Therefore, there is a need for an improved bone conduction hearing aid for hearing loss patients with limited treatment options.

BRIEF SUMMARY OF THE INVENTION

The present invention achieves its objectives by providing a bone conduction hearing aid having an acoustic vibration sensor for sensing acoustic vibrations and producing an acoustic vibration signal corresponding to the sensed acoustic vibrations. The acoustic vibration signal is received and amplified by electronics to produce an amplified acoustic vibration signal. A power supply supplies electrical power to the electronics. Preferably, the acoustic vibration sensor, electronics, and power supply are carried by a behind-the-ear member. The invention further includes an in-the-ear (ITE) member having an insertion portion for being inserted into a user's ear canal adjacent the mastoid bone. A non-insertion portion of the ITE member is connected to the insertion portion and positioned in the concha of the user's ear when the insertion portion is positioned in the user's ear canal. A vibrator is carried by and in vibrational communication with the insertion portion. The vibrator is configured to receive the amplified acoustic vibration signal and to produce vibrations which are conducted by the insertion portion to the mastoid bone of the user.

The insertion portion of the ITE member may be fabricated from a variety of vibrationally conductive materials, including hard plastic, hard lucite, and acrylic. If needed or desired, the non-insertion portion of the ITE member may be fabricated from a vibration attenuating material, such as rubber, to reduce or eliminate feedback from the vibrator. The ITE member may be vented to assist patients with certain conductive pathologies involving drainage of the ear.

The hearing aid may further include a volume control interface electrically connected to the electronics to control amplification of the acoustic vibration signal. In addition, feedback reduction circuitry and an associated feedback control interface may be provided as needed to control feedback from the vibrator.

BRIEF DESCRIPTION OF THE DRAWINGS

Preferred embodiments of the invention will now be described in further detail. Other features, aspects, and advantages of the present invention will become better understood with regard to the following detailed description, appended claims, and accompanying drawings (which are not to scale) where:

DETAILED DESCRIPTION OF THE PREFERRED EMBODIMENT(S)

Figure 1:
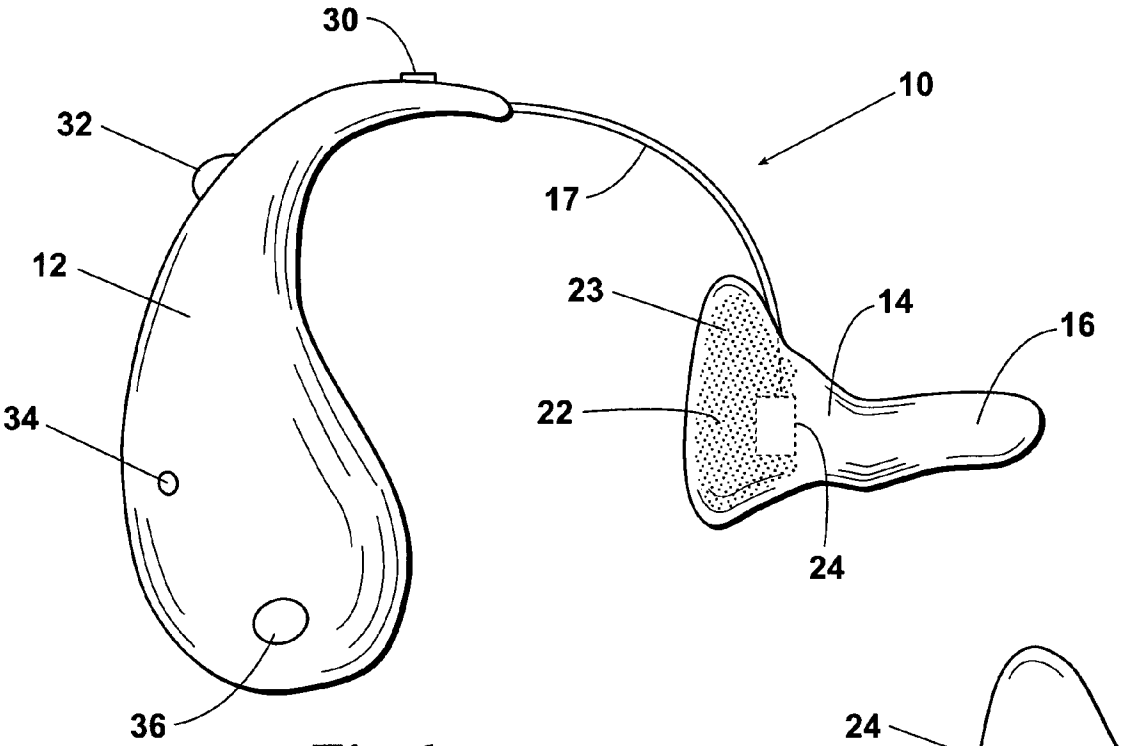
FIG. 1 is a side view of a bone conduction hearing aid according to the invention.
Figure 2:
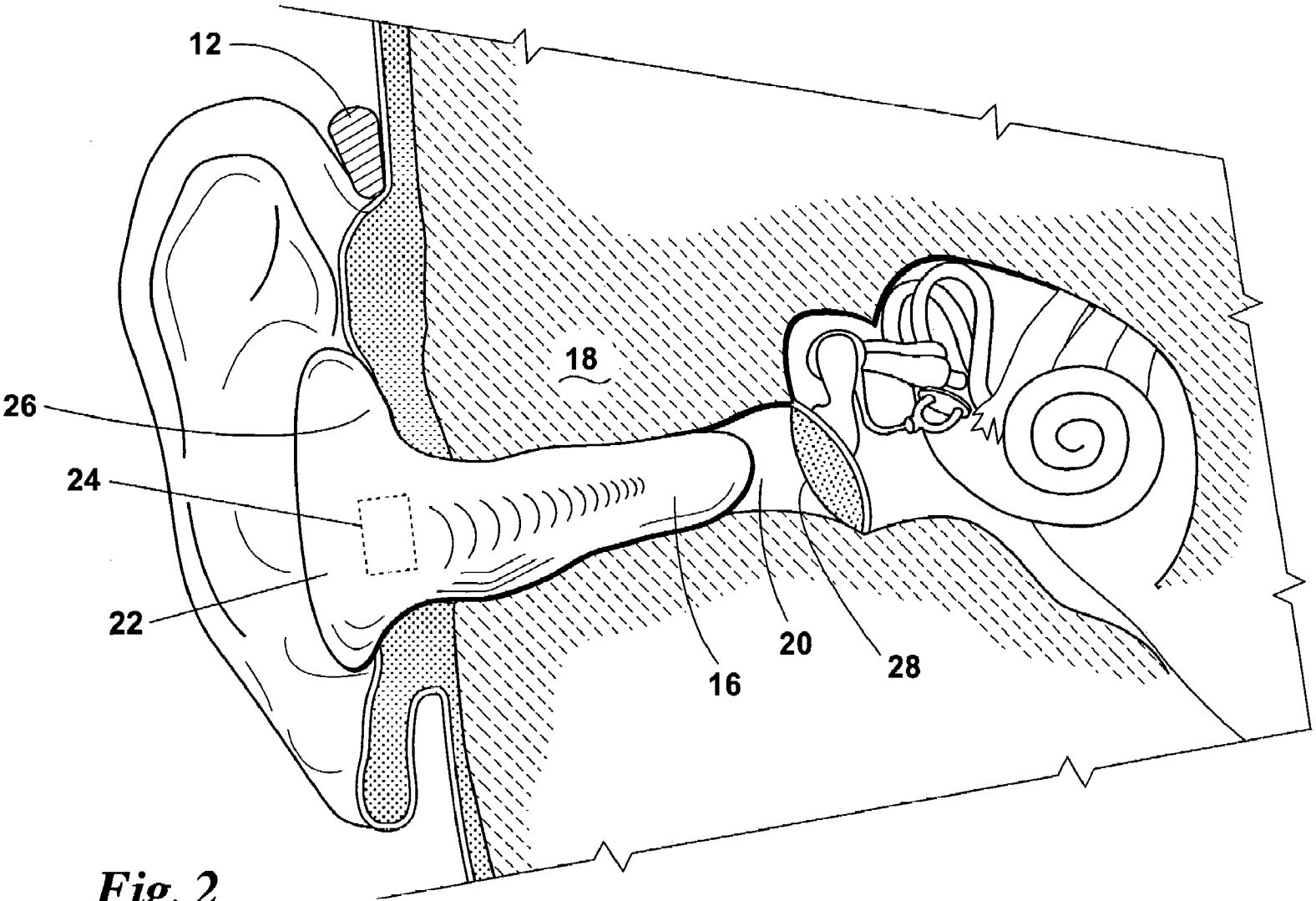
FIG. 2 is a sectional view of a patient wearing the hearing aid of FIG. 1.

Turning now to the drawings wherein like reference characters indicate like or similar parts throughout, FIGS. 1 and 2 illustrate a bone conduction hearing aid 10 in accordance with the invention. The hearing aid 10 preferably includes a behind-the-ear (BTE) member 12 for carrying elements needed to receive and process acoustic vibrations, and an in-the-ear (ITE) member 14 configured to receive signals processed by the BTE member 12 and convert those signals to corresponding vibrations that are conducted by the mastoid bone to a cochlea of the patient or user. BTE member 12 is in electronic communication with ITE member 14. In a preferred embodiment as shown in FIG. 1, the two members 12, 14 are connected by an electrically conductive line 17. Alternatively, a transmitter transmits processed signals to ITE member 14 wirelessly, such as by radio frequency.

With continued reference to FIGS. 1 and 2, ITE member 14 includes an insertion portion 16 for being inserted into the user's ear canal adjacent the mastoid bone 18. Insertion portion 16 is preferably custom formed to closely fit the ear canal of the user, and FIG. 2 shows the hearing aid 10 fully inserted in the patient's ear canal 20. A non-insertion portion 22 adjacent to and connected with the insertion portion 16 is positioned in the concha 26 of the ear when the hearing aid 10 is in use. A non-surgically implanted vibrator 24 carried by (i.e., mounted on or in) the non-insertion portion 22 is in vibrational communication with the insertion portion 16. Vibrations produced by vibrator 24 are conducted by the insertion portion 16 to the mastoid bone 18. Thus, when insertion portion 16 is inserted in the ear canal 20, the vibrator 24 is positioned in the concha 26. This configuration is particularly advantageous for patients with ear canals that are too small to receive the vibrator 24, including patients with congenital atresia where the ear canal is extremely narrow or completely closed off from the tympanic membrane 28. For example, aural atresia occurs where there is an absence of the opening to the ear canal. Bony atresia occurs where there is a congenital blockage of the ear canal due to a wall of bone separating the ear canal from the middle ear space. For atresia patients, the concha 26 provides a location with sufficient space to receive the vibrator 24.

As mentioned above, BTE member 12 is configured to receive and process acoustic vibration signals and to provide the processed signals to ITE member 14 for operation of vibrator 24. External features of BTE member 12 shown in FIG. 1 include an acoustic vibration sensor, or microphone 30, for receiving acoustic vibration, a volume control 32 for controlling the level of amplification provided by the hearing aid 10, and an optional feedback control 34 for adjusting electronic parameters to reduce or eliminate feedback from the vibrator 24. Access to the hearing aid battery 36 is also provided.

The insertion portion 16 of the hearing aid 10 is preferably formed from a vibrationally conductive material suitable for transferring vibration produced by the vibrator 24 into the ear canal 20 and then to the mastoid bone 18. Suitable materials include hard plastic, hard lucite and acrylic. In a preferred embodiment, vibrator 24 is an electromechanical vibrator, such as a "moving coil" type. Piezoelectric and other vibrator types may also be employed in accordance with the invention.

Vibration produced by the vibrator 24 may be transferred through the hearing aid 10 and picked up by the microphone 30, producing undesirable feedback particularly at higher amplifications. Feedback may be controlled by coating or otherwise fabricating non-insertion portion 22 with a vibration attenuating material 23, such as rubber. If electronic feedback reduction is desired, a feedback control 34 is provided to enable user adjustment of feedback control circuitry carried by BTE member 12.

In operation, sound waves are received by the microphone 30 and the microphone 30 outputs a corresponding microphone signal. The microphone signal is amplified and the amplified microphone signal is provided to the vibrator 24. Vibrations produced by the vibrator 24 are conducted by insertion portion 16 into the ear canal 20 and on to the mastoid bone 18, which in turn transfers the vibration to a cochlea of the user to enhance hearing perception. Thus, sound perception in patients with hearing loss is improved. Conducting vibration into the ear canal 20 in close proximity to the mastoid bone 18 provides excellent transfer of vibration to a cochlea by way of the mastoid bone 18.

The hearing aid 10 can function to improve hearing in either ear. For example, patients with conductive pathology in one ear can experience improved hearing perception by placing the hearing aid 10 in the ear with the conductive loss. Vibrations produced by the vibrator 24 are transferred by way of the mastoid bone 18 to the cochlea of the affected ear. The hearing aid 10 can also be used by patients with total loss of hearing in one ear. For such patients, the hearing aid 10 operates to transmit vibration output by vibrator 24 transcranially through the mastoid bone 18 from the bad ear to the good ear. Transcranial conduction of the vibrator output in this manner overcomes problems associated with the "head shadow" effect where sounds coming from the direction of the deaf ear are attenuated by the patient's head.

Figure 3:
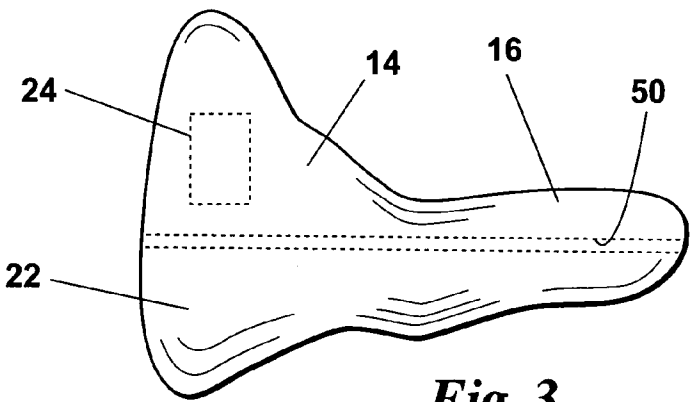
FIG. 3 is a side view of a vented in-the-ear member according to the invention.

The hearing aid 10 can also be used to help patients that have certain conductive pathologies involving drainage from the ear. To enable the ear to properly drain, an ITE type hearing aid should be vented. Due to space constraints, it is very difficult to fabricate a bone conducting ITE hearing aid with a vent and a vibrator positioned in the ear canal. FIG. 3 shows how ITE member 14 can be configured to assist patients with such conductive pathologies. A vent 50 is provided to enable air to enter the ear canal for proper drainage of the ear. Vibrator 24 is located on or in non-insertion portion 22 where space is not as limited as in insertion portion 16. This configuration of ITE member 14 provides a treatment solution that was previously unavailable to patients with conductive pathologies that involve drainage of the ear.

The hearing aid 10 can even be used to improve hearing perception in individuals with no hearing loss in either ear. In extremely noisy environments, the hearing aid 10 can function both as a plug and as a filter which electronically filters the noise while allowing desired sound to be perceived. For example, aircraft maintenance personnel are commonly required to work in close proximity to aircraft while the engines are turning. Good communication among the maintenance crew is essential from a safety standpoint as well as to ensure the aircraft is in proper working condition. A hearing aid in accordance with the invention would be particularly useful in this type of noisy environment since it would block aircraft noise by acting as a plug, electronically filter the engines' higher frequency noise components, and still allow the lower frequency human voice to be sensed and perceived by the user.

Figure 4:
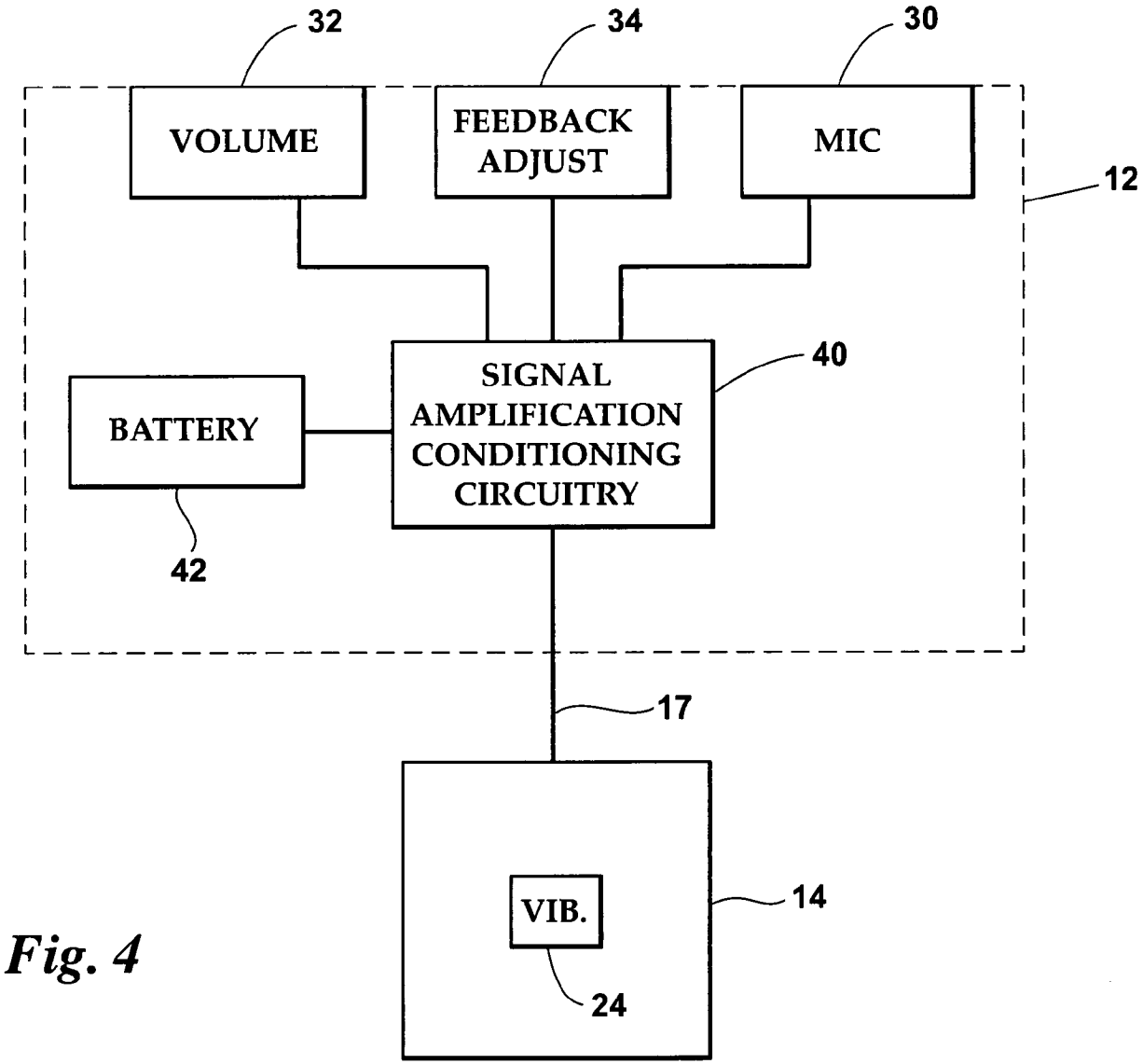
FIG. 4 is a functional block diagram of a hearing aid according to the invention.

A functional block diagram of a hearing aid 10 according to the invention is shown in FIG. 4. Sound waves are received by the microphone 30 which outputs a microphone signal to the signal amplification circuitry 40. The microphone signal is amplified by an amplifier within the signal amplification circuitry 40 and the amplified signal is sent to the vibrator 24 which produces vibrations corresponding to the amplified microphone signal. Electrical power is provided by a battery 42. The level of amplification can be adjusted with the volume control 32.

The foregoing description details certain preferred embodiments of the present invention and describes the best mode contemplated. It will be appreciated, however, that changes may be made in the details of construction and the configuration of components without departing from the spirit and scope of the disclosure. Therefore, the description provided herein is to be considered exemplary, rather than limiting, and the true scope of the invention is that defined by the following claims and the full range of equivalency to which each element thereof is entitled.

What is claimed is:

1. A bone conduction hearing aid comprising:

an acoustic vibration sensor for sensing acoustic vibrations and producing an acoustic vibration signal corresponding to the sensed acoustic vibrations;

electronics for receiving and amplifying the acoustic vibration signal to produce an amplified acoustic vibration signal;

a power source for supplying electrical power to the electronics; and an in-the-ear member having:

an insertion portion for being inserted into a user's ear canal adjacent the mastoid bone;

a non-insertion portion connected to said insertion portion and positioned in the concha of the user's ear when said insertion portion is positioned in the user's ear canal; and a vibrator carried by said non-insertion portion and in vibrational communication with said insertion portion, said vibrator being configured to receive the amplified acoustic vibration signal and produce vibrations which are conducted by the insertion portion to the mastoid bone of the user.

2. The hearing aid of claim 1, further comprising a behind-the-ear member for carrying said acoustic vibration sensor, electronics, and power source.

3. The hearing aid of claim 1 wherein the insertion portion of said in-the-ear member is fabricated from acrylic.

4. The hearing aid of claim 1 wherein the insertion portion of said in-the-ear member is fabricated from hard plastic.

5. The hearing aid of claim 1 wherein the non-insertion portion of said in-the-ear member is fabricated from a vibration attenuating material.

6. The hearing aid of claim 1, further comprising a volume control interface electrically connected to said electronics for controlling amplification of the acoustic vibration signal.

7. The hearing aid of claim 1 wherein said electronics include feedback reduction circuitry for reducing feedback from the vibrator to the acoustic vibration sensor.

8. The hearing aid of claim 7, further comprising a feedback control interface electrically connected to said electronics for controlling feedback reduction.

9. The hearing aid of claim 1 wherein said in-the-ear member further includes a vent for venting air through the in-the-ear member to the ear canal of the user.

10. A bone conduction hearing aid comprising:

a behind-the-ear member for being worn behind the ear of a user, said behind-the-ear member having:

an acoustic vibration sensor for sensing acoustic vibrations and producing an acoustic vibration signal corresponding to the sensed acoustic vibrations;

electronics for receiving and amplifying the acoustic vibration signal to produce an amplified acoustic vibration signal; and a power source for supplying electrical power to the electronics; and an in-the-ear member for being partially inserted into the ear canal of a user, said in-the-ear member having:

an insertion portion for being removably inserted into a user's ear canal adjacent the mastoid bone;

a non-insertion portion connected to said insertion portion and positioned in the concha of the user's ear when said insertion portion is positioned in the user's ear canal; and a vibrator carried by said non-insertion portion and in vibrational communication with said insertion portion, said vibrator being configured to receive the amplified acoustic vibration signal and produce vibrations which are conducted by the insertion portion to the mastoid bone of the user.

11. The hearing aid of claim 10 wherein the insertion portion of said in-the-ear member is fabricated from acrylic.

12. The hearing aid of claim 10 wherein the insertion portion of said in-the-ear member is fabricated from hard plastic.

13. The hearing aid of claim 10 wherein the non-insertion portion of said in-the-ear member is fabricated from a vibration attenuating material.

14. The hearing aid of claim 10, further comprising a volume control interface electrically connected to said electronics for controlling amplification of the acoustic vibration signal.

15. The hearing aid of claim 10 wherein said electronics include feedback reduction circuitry for reducing feedback from the vibrator to the acoustic vibration sensor.

16. The hearing aid of claim 15, further comprising a feedback control interface electrically connected to said electronics for controlling feedback reduction.

17. The hearing aid of claim 10 wherein said in-the-ear member further includes a vent for venting air through the in-the-ear member to the ear canal of the user.

18. A bone conduction hearing aid comprising:

a behind-the-ear member for being worn behind the ear of a user, said behind-the-ear member having:

an acoustic vibration sensor for sensing acoustic vibrations and producing an acoustic vibration signal corresponding to the sensed acoustic vibrations;

electronics for receiving and amplifying the acoustic vibration signal to produce an amplified acoustic vibration signal; and a power source for supplying electrical power to the electronics; and an in-the-ear member for being partially inserted into the ear canal of a user, said in-the-ear member having:

an insertion portion for being removably inserted into a user's ear canal adjacent the mastoid bone;

a non-insertion portion connected to said insertion portion and positioned in the concha of the user's ear when said insertion portion is positioned in the user's ear canal, said non-insertion portion being fabricated from a vibration attenuating material; and a vibrator carried by said non-insertion portion and in vibrational communication with said insertion portion, said vibrator being configured to receive the amplified acoustic vibration signal and produce vibrations which are conducted by the insertion portion to the mastoid bone of the user.

* * * * *